United States Patent [19]

Palmer

[11] 4,120,376

[45] Oct. 17, 1978

[54] NOISE CONTROL ENCLOSURE

[76] Inventor: Charles E. Palmer, Turnpike Rd., Somers, Conn. 06071

[21] Appl. No.: 739,485

[22] Filed: Nov. 8, 1976

[51] Int. Cl.[2] ..... E04B 1/82

[52] U.S. Cl. ..... 181/204; 181/284

[58] Field of Search ..... 181/198-205, 181/284

[56] References Cited

U.S. PATENT DOCUMENTS

| | | | |
|---|---|---|---|
| 3,276,539 | 10/1966 | Dear et al. | 181/204 |
| 4,016,689 | 4/1977 | Wendt | 181/284 |

*Primary Examiner*—Robert C. Watson

[57] ABSTRACT

A noise control enclosure comprises an assembly of a plurality of panels each having a structural framework on which a sound deadening sheet material is affixed. The structural framework is formed of frame members which have mounting flanges which are disposed about the periphery of the structural framework of each panel. The sound deadening sheet is permanently affixed thereto, for example by a suitable adhesive. Individual panels are removably connected to each other to form the enclosure by fastening means such as self-tapping screws. The sheet material is interposed between abutting frame members of adjacent panels. Peripheral edges of the sheets mounted on the framework or strips of similar material extend between abutting frame members of the structural framework to provide acoustic sealing between panels. The individual panel construction permits on site assembly and disassembly.

19 Claims, 12 Drawing Figures

NOISE CONTROL ENCLOSURE

BACKGROUND OF THE INVENTION

The present invention relates to sound deadening enclosures or chambers, particularly to enclosures adapted to enclose machinery and the like to reduce the noise level emanating therefrom.

It is well-known, of course, that high noise levels adversely affect the general well-being and health of persons exposed thereto. Not only is hearing impaired by prolonged exposure to excessively high noise levels, but fatigue and tension are increased thereby. In manufacturing plants, offices, and in work places of every description, attempts are often made to reduce noise levels to provide a healthier and more pleasant working of other environment as well as to meet increasingly rigid legal limits on noise level and to improve productivity in work environments.

In general, the use of sound deadening enclosures or acoustic covers is well-known as shown, for example, by U.S. Pat. Nos. 3,222,233 and 3,478,958.

U.S. Pat. No. 3,534,828 shows acoustic panels used to clad an internal combustion engine. U.S. Pat. No. 3,747,735 shows a cabinet-like enclosure for office equipment.

U.S. Pat. No. 3,881,569 shows a small room-like enclosure adapted to enclose machinery for sound proofing or sound deadening. Particularly with this type of enclosure, problems are associated with the prior art structures. For one thing, such enclosures are usually employed on custom-designed production facilities or are added to already existing facilities. It is therefore necessary to custom-design and build the sound deadening enclosure with the attendant increased cost of such custom work.

Another problem associated with such sound deadening structures is that it is occasionally necessary to dismantle the structure to permit access to the machine which is encloses. Even if the enclosure is designed for such disassembly, the integrity of acoustical seals between sections of the enclosure is often lost or compromised by the disassembly and reassembly. Even though acoustically sealable access doors may be provided, occasionally dismantling of the enclosure is necessary for replacement or major overhaul of the machinery enclosed.

It is therefore an object of the present invention to provide a novel sound deadening enclosure which may be built to custom specifications from standard panel components.

It is another object of the present invention to provide a sound deadening enclosure assembled from a plurality of individual sound deadening panels which panels may be repeatedly assembled and disassembled without compromising the quality of the acoustical seal between adjacent panels.

It is another object of the present invention to provide a sound deadening enclosure assembled from a plurality of sound deadening panels which enclosure has an external structural framework which is completely shielded from the sound emanating from sources within the enclosure by sound deadening material sheets affixed to the framework.

It is another object of the present invention to provide a sound deadening panel adapted to be assembled with a plurality of similar or identical panels into a sound deadening enclosure, the panels comprising frame members forming a structural framework including mounting flanges and support flanges with the sound deadening sheet material affixed to the mounting flanges and individual panels disengageably connectable to each other.

Other objects and advantages of the invention will be apparent from the following detailed description thereof.

SUMMARY OF THE INVENTION

In accordance with the present invention, there is provided a sound deadening enclosure comprising a plurality of sound deadening panels which are disengageably assembled to each other to form the enclosure. The panels each have a structural frame extending about the periphery thereof and comprised of oppositely disposed frame members secured to each other to provide the frame and an opening therein. Each of the frame members of a panel have a mounting surface extending inwardly of the periphery of the frame and a sheet of sound deadening material extends across and closes the opening and overlies the mounting surfaces of the frame members of each structural frame. Each of the sheets of sound deadening material is disposed so as to cover its associated structural frame whereby the structural frames are completely shielded by the sound deadening material from the interior of the enclosure. Means secure the overlying portions of each of the sheets to the mounting surfaces it overlies and fastening means disengageably connect abutting frame members of adjacent panels to each other with a portion of the sound deadening sheet of the panels interposed between at least some abutting frame members to provide an acoustical seal therebetween.

Certain objects of the invention are attained by further including in the enclosure at least one strip of sound deadening material interposed between those of the abutting frame members which do not have the portion of the sound deadening sheet of the panels interposed therebetween. Such strip provides an acoustical seal between abutting frame members between which it is interposed.

The sheets of sound deadening material may comprise a resilient, compressible material such as a core of foamed plastic material (eg., polyurethane foam) sandwiched between opposed layers of plastic material which is of higher density than the foamed plastic material, (eg., vinyl plastic material).

Other objects of the invention are attained by providing a sound deadening panel adapted to be disengageably assembled with other like panels to form a sound deadening enclosure. The panel comprises a structural frame extending about the periphery of the panel, the frame being formed of oppositely disposed frame members secured to each other to provide the frame and an opening in it. Each of the frame members has one surface extending inwardly of the periphery of the frame to provide a mounting surface and another surface extending divergingly from the mounting surface to provide a support surface extending from the mounting surface towards the side of the frame opposite the mounting surface. A sheet of sound deadening material extends across and closes the opening to define one side of the panel and has peripheral edge portions which overlie the mounting surface. The sheet of sound deadening material is disposed so as to cover the structural frame whereby the structural frame is completely shielded by the sound deadening material on the aforesaid one side of the panel. Means (eg., adhesive or adhesive and mechanical fasteners) secure the peripheral edge portions of the sheet to the mounting surface. Means (such as threaded holes) are in the support surfaces to permit disengageable connections of the support surfaces to the other like panels.

The frame members may comprise angle iron members, eg., a right-angle angle iron with the two flanges thereof disposed at right angles to each other. One flange of the angle iron provides the mounting surface in the form of a mounting flange and the other surface thereof provides the support surface in the form of a support flange.

DESCRIPTION OF THE PREFERRED EMBODIMENTS

Figure 1:
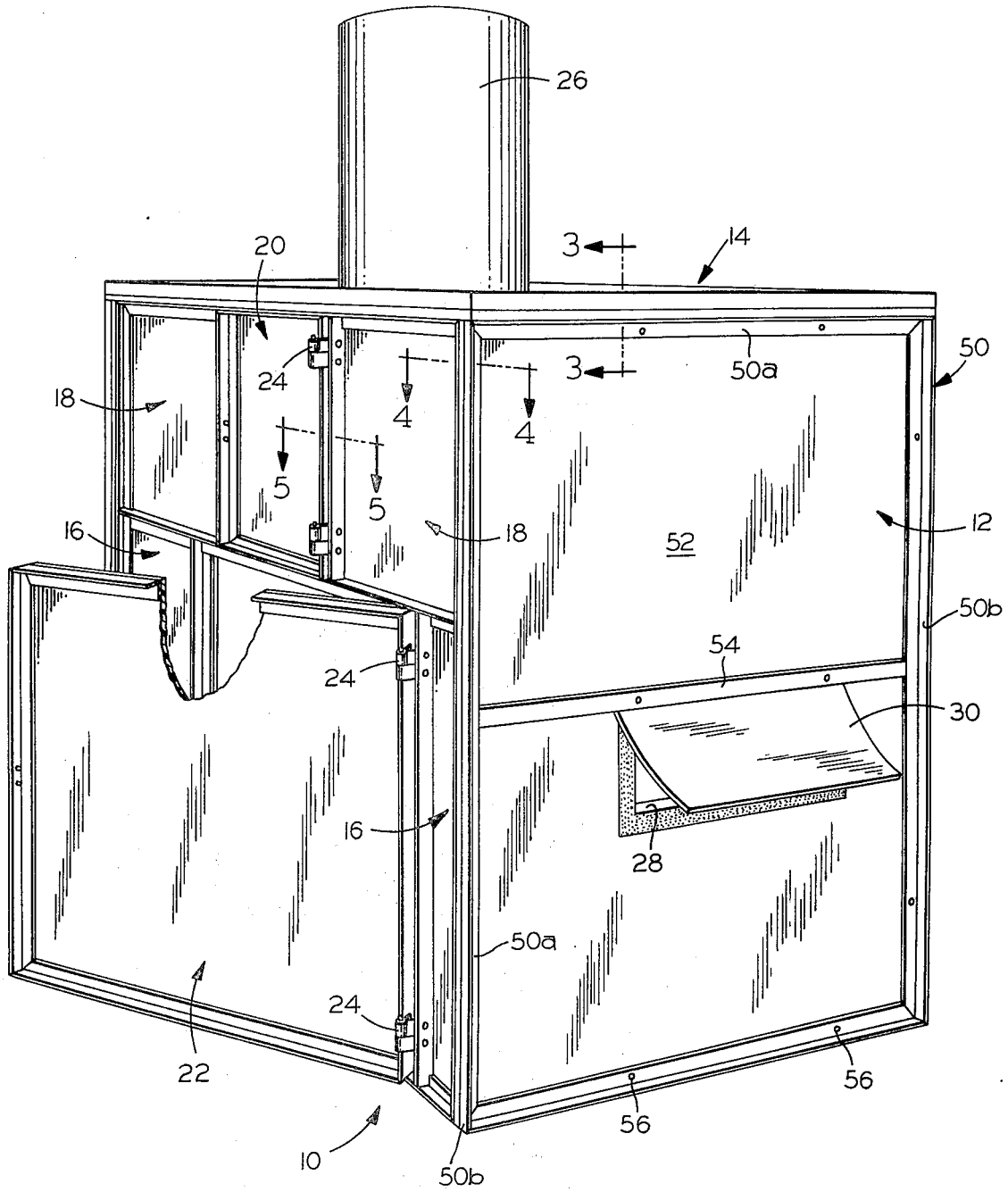
FIG. 1 is a perspective view of one embodiment of a sound deadening enclosure in accordance with the present invention.

Referring to FIG. 1, a sound deadening enclosure is generally indicated at 10 and includes side panels 12, a top panel 14 and small front panels 16, 18. Panels 16, 18 are sized to permit mounting of upper door panel 20 and lower door panel 22 on, respectively, hinges 24. Door 22 is shown partially broken away for clarity of illustration. A vent 26 emerges through top panel 14 and is connected to machinery (not shown) enclosed within sound deadening enclosure 10. Enclosure 10 is a box-like enclosure closed on all sides by a side panel (not visible in FIG. 1) opposite side panel 12, and a back panel (not visible in FIG. 1) opposite front panels 16, 18.

Side panel 12 has an access opening 28 provided therein which is closable by a flap closure 30, shown in an open position in FIG. 1.

Figure 8:
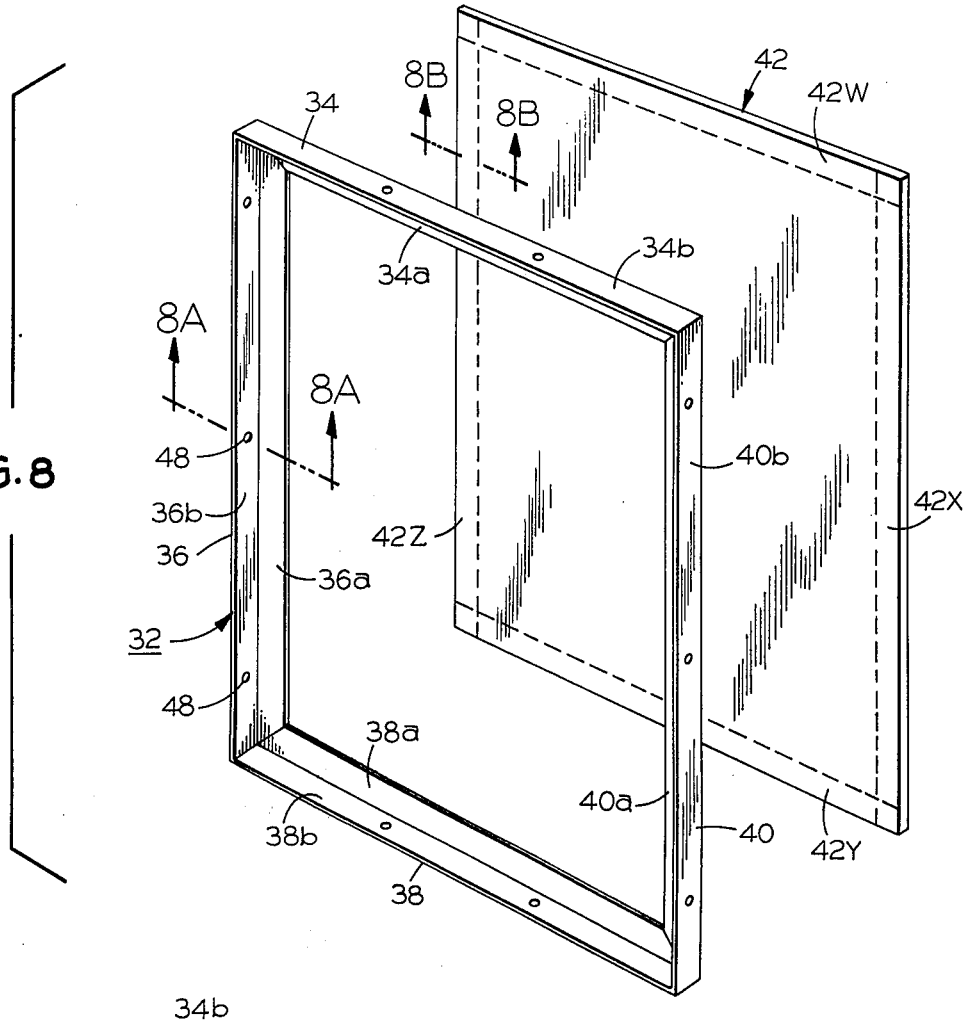
FIG. 8 is a perspective exploded view of a typical sound deadening panel in accordance with the invention.
Figure 8A:
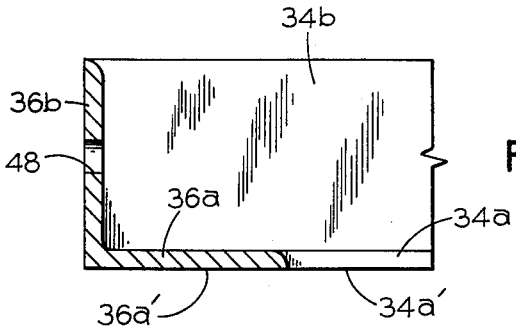
FIG. 8A is a cross-section view taken along line 8*a*—8*a* of FIG. 8.
Figure 8B:
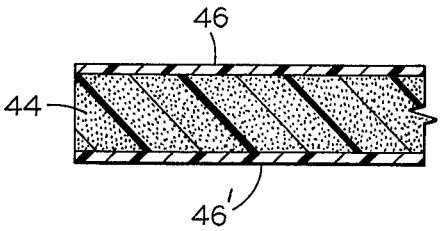
FIG. 8B is a cross-section view taken along line 8*b*—8*b* of FIG. 8.

While the various sound deadening panels forming respective parts of enclosure 10 are differently sized, their basic form of construction is identical, as illustrated in FIG. 8. In FIG. 8, a structural framework 32 is generally rectangular in shape and comprises four frame members 34, 36, 38, and 40 which are lengths of right-angle iron welded together to form framework 32. One flange (34*a*, 36*a*, 38*a*, 40*a*) of each angle iron lies in a common plane and defines mounting flanges of framework 32; the other respective flanges (34*b*, 36*b*, and 40*b*) which extend generally perpendicularly from their associated mounting flanges comprise support flanges of framework 32. A sound deadening material sheet 42 is affixed to structural framework 32 by gluing or otherwise fastening the peripheral edge portions 42*w*, 42*x*, 42*y*, and 42*z* thereof to the inner-facing side of support flanges 36*a*, 36*b*, 36*c*, and 36*d*. The inner-facing side of the respective mounting flanges is the side of framework 32 opposite that from which support flanges 36*a*, 36*b*, 36*c*, and 36*d* extend; the inner-facing side of mounting flanges 34*a* and 36*a* is indicated in FIG. 8A at 34*a*' and 36*a*'. The sound deadening panel is seen to comprise a sound deadening material sheet 42 disposed so as to cover its associated structural framework 32 whereby structural framework 32 is completely shielded by material sheet 42 from the interior of an enclosure formed by a plurality of such sound deadening panels.

Sound deadening material sheet 42 may be made of any suitable sound absorbing and/or reflecting material, or a composite material. Such materials are well-known in the art and are selected to most efficiently reduce the noise level perceived outside the enclosure depending on the loudness, frequency, and other characteristics of the noise which is sought to be suppressed. Thus, the specific material or composite of materials from which sound deadening material sheet 42 is made will be selected for its appropriate acoustical values of sound transmission, noise reduction coefficient, etc. Typically, a hollow or cellular, granular, or fibrous structure is employed. A preferred sound absorbing material may include a plastic, ie., synthetic organic polymeric, material which may optionally be supplemented by denser material such as lead sheet, or particulated lead or other materials.

A preferred sound deadening material is illustrated in the drawings and comprises a foamed plastic material 44, e.g., polyurethane foam, core sandwiched between opposite layers 46, 46' of a denser plastic material, eg., a vinyl sheet. The vinyl sheet may have its mass increased by the incorporation therein during the process of molding or otherwise making of the vinyl sheet of powdered lead, barium sulfate or similar materials. Such sound deadening material, substitutes for and equivalents of which are well-known in the art and accordingly will not be described herein.

Obviously, means other than adhesives may be employed to affix sheet 42 to framework 32, such as mechanical fasteners of any suitable type. However, for convenience and ease of manufacture, and for reducing sound vibrations transmitted through the enclosure to be made from the panel, the use of adhesives is preferred. Numerous epoxy and other adhesives capable of bonding materials such as vinyl sheet to metal are well-known and commercially available. For example, an adhesive sold under the tradename Velcro No. 40 by American Velcro Company has been found to be highly satisfactory in gluing sound deadening material sheet having vinyl based outer sheets to angle iron.

Holes 48 are provided at intervals along support flanges 36*a*, 36*b*, 36*c*, 36*d* and are used to receive connectors such as self-tapping screws to connect the panel to adjacent panels.

Figure 2:
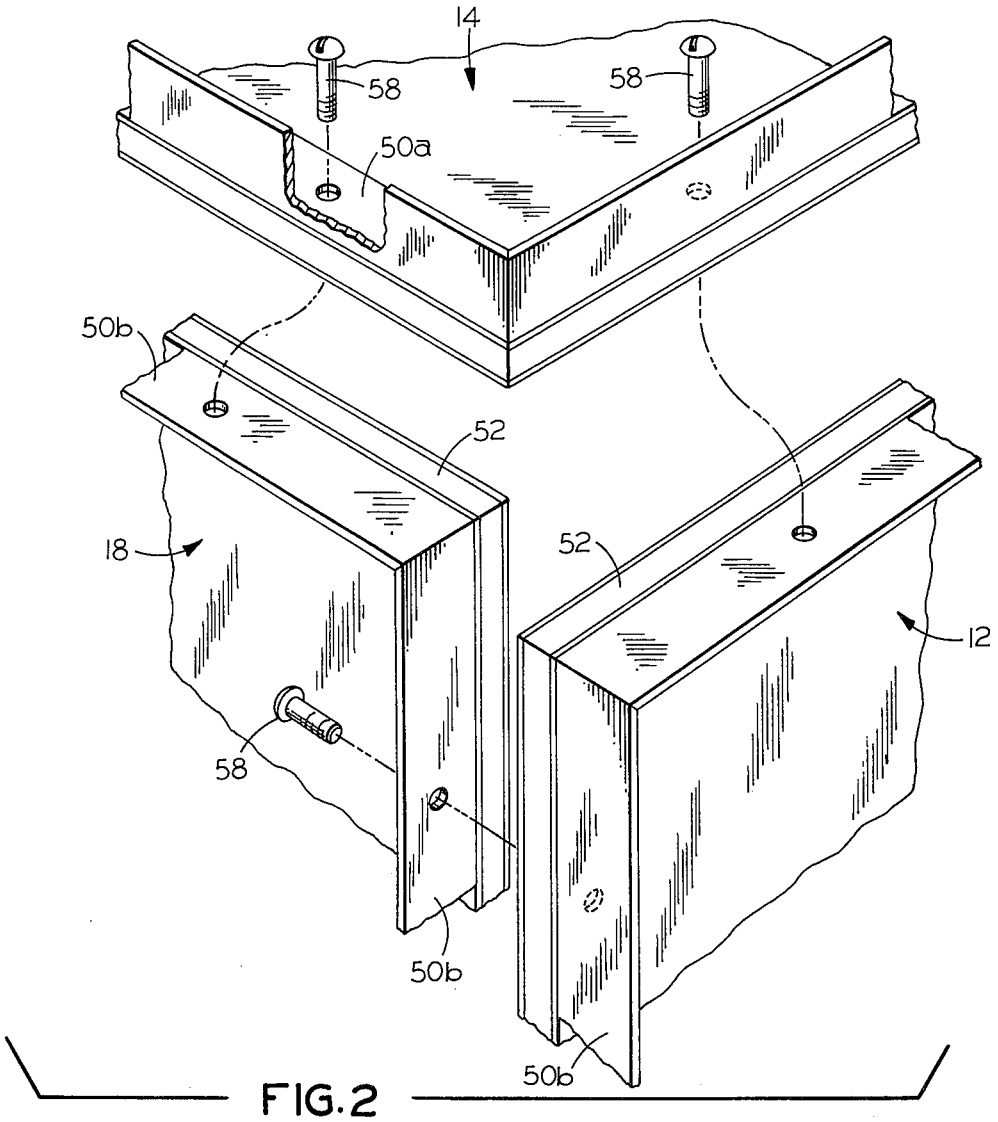
FIG. 2 is a partial exploded view, on a scale enlarged with respect to FIG. 1, of a corner portion of the enclosure of FIG. 1.
Figure 3:
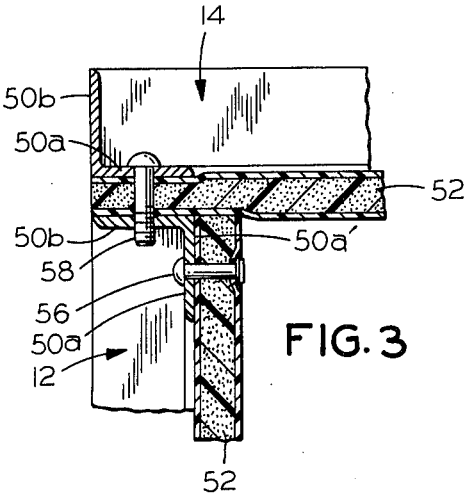
FIG. 3 is a cross-section view taken along line 3—3 of FIG. 1.
Figure 4:
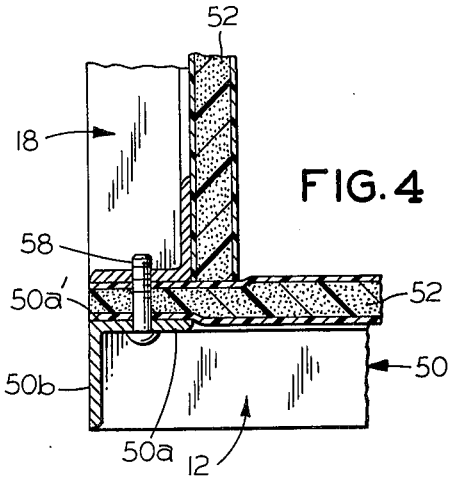
FIG. 4 is a cross-section view taken along line 4—4 of FIG. 1.
Figure 5:
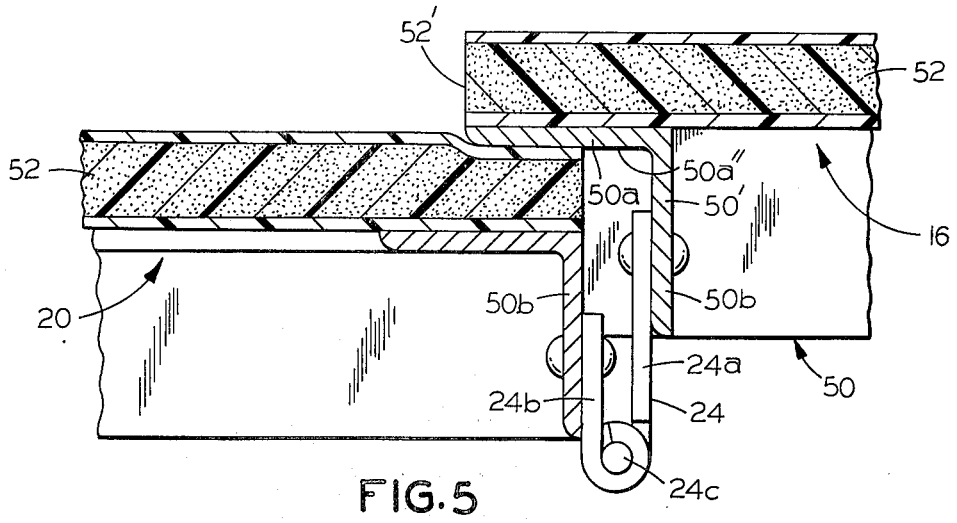
FIG. 5 is a cross-section view taken along line 5—5 of FIG. 1.

Referring now to FIGS. 1 through 5, additional details of the construction of enclosure 10 are shown. The construction described with reference to the panel illustrated in FIG. 8 is typical of panels 12, 14, 16, 18, 20, and 22, each of which comprises an angle iron structural framework having mounting flanges and support flanges with a sound deadening sheet material permanently affixed thereto, preferably by an adhesive. Thus, side panel 12 comprises a structural framework 50 made of angle iron having mounting flanges 50*a* and support flanges 50*b*. A sound deadening material sheet 52 is affixed to the inner facing side of mounting flanges 50*a*, as seen in FIGS. 3 and 4. Sound deadening panel 12, because of its size, is structurally reinforced by a flat iron or steel bar 54 welded to opposite sides of structural framework 50 and extending across the horizontal center line thereof. Structural framework 50 is typically of welded construction.

As above described, an access opening 28 is cut in sheet 52 for convenient access to and observation of the machinery contained within the enclosure 10. Flap closure 30 is made of the same material as sheet 52, which is flexible and permits ready opening and closing of closure 30. A convenient means of affixing closure 30 to sheet 52 is the use of fabric tapes employing respectively a series of hook and eye shaped pile threads which, when pressed into contact, interlock yet can be readily pulled apart as required. Such tape is commercially available under the trademark Velcro.

As shown in FIG. 3, rivet-type fasteners 56 may be employed at intervals along structural framework 50 to supplement to adhesives (not shown) used to affix sheet 52 to structural framework 50. While not always necessary, such supplemental mechanical fastening is useful, particularly with large panels, to increase the strength of the bonding of sheets 52 to framework 50.

Sound deadening material sheets 52 are seen to extend over and close to central opening defined by the respective structural frameworks 50, more particularly by the inner periphery defined by inner edge of mounting flanges 50*a*. It will be further noted that sheets 52 are substantially coextensive with structural frameworks 50 in that peripheral edge portions of sheets 52 extend over and cover the inner facing sides (50*a*′ in FIGS. 3 and 4) of mounting flanges 50*a*.

As may best be seen in FIG. 2, the various panels (12, 14, and 18) are of substantially similar construction and adjacent panels are connected together by self-tapping screws.

More specifically, as shown in FIG. 2, abutting frame members of panels 12 and 18 are connected to each other self-tapping screws which pass through a hole provided in support flange 50*b* of the structural framework of panel 18, through a peripheral edge portion of sheet 52 of panel 12 and into a corresponding hole provided in mounting flange 50*b* of abutting frame member of panel 12. Panels 12 and 18 are thus connected in abutting, non-coplanar relationship, i.e., they are disposed substantially at a right angle to each other.

Top panel 14 is similarly connected through the mounting flange 50*a* to abutting support flange 50*b* of, respectively, panels 12 and 18.

As best appreciated in FIGS. 3 and 4, preipheral edge portions of sheet 52 are thus interposed between a mounting flange of one abutting frame member and a support flange of the associated abutting frame member. A suitable degree of tightening of self-tapping screws 58 compresses the peripheral edge portions of sheets 52 between the respective flanges to form an efficient acoustical seal between the adjacent abutting panels. Sheets 52 are preferably resilient and compressible.

This seal is not adversely affected when it becomes necessary to disassemble and thereafter reassemble the panels. For example, in FIG. 3, sheet 52 of top panel 14 is permanently affixed, preferably by adhesives and optionally supplemented by rivet-type or other mechanical fasteners, to structural framework 50 of panel 14. Sheet 52 of panel 12 is similarly secured to its structural framework.

The connector means, in this embodiment comprising self-tapping screws 58 which secure the panels one to the other and which compress the peripheral edge portions of sheet 52 between adjacent flanges of abutting panels, may repeatedly be removed and replaced to reconstitute an effective acoustical seal.

As will be seen from FIG. 4, the same type of construction and the same advantage of a removable acoustical seal, without breaking any permanent bonding, is provided by the abutment of adjacent panels 12 and 18. Thus, a removable acoustical seal is provided between adjacent panels, such as panels 12 and 18, which are both disposed vertically but at an angle (eg., a right angle) to each other and between a horizontal panel (panel 14) supported by vertical panels (eg. panels 12 and 18).

As illustrated in FIG. 1, panels may be inset within a number of surrounding panels and hinged to one of them to provide a hinged door access panel. This hinged construction is shown in some detail in FIG. 5 in which hinge 24 is shown to be conventionally connected to a support flange 50*b* of panel 16 and to support flange 50*b* of upper door panel 20. Hinge 24 has leaves 24*a* and 24*b* which pivot about hinge pin 24*c* in the conventional manner. It will be noted that frame member 50′ of structural framework 50 of panel 16 is reversed so that support flange 50*b* thereof is set back from the peripheral edge 52′ of sheet 52 and the outer peripheral edge of its mounting flange 50*a*. This permits the outer facing surface 50*a*″ of mounting flange 50*a* to provide a sealing surface for the peripheral edge portion of sheet 52 of upper door panel 20. Thus, with door panel 20 in its closed position, compression sealing of the peripheral edge portions of its sheet 52 is attained.

Figure 6:
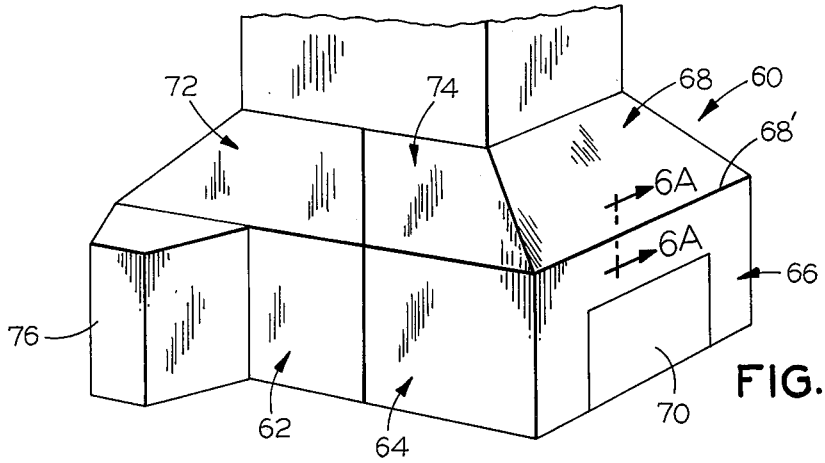
FIG. 6 is a schematic view of another embodiment of the invention on a scale greately reduced as compared to FIG. 1.

While the enclosure embodiment of FIG. 1 is of rectangular box-like construction and readily assembled from flat, planar sound deadening panels, the invention is obviously not limited to this type of construction. Referring, for example, to FIG. 6, there is shown a tent shaped sound deadening enclosure generally indicated at 60. Enclosure 60 is assembled from generally rectangular panels 62, 64, 66, and 68. Panel 66 has a hinged door panel 70 provided therein. A portion of the upper part of enclosure 60 is formed of trapezoidal shaped panels 72, 74. A booth-like enclosure 76 is removably connected to panels 62, 72 and a panel (not visible in FIG. 6) opposite panel 66. Booth-like enclosure 76 accommodates a projecting portion of the machinery or equipment (not shown) contained within enclosure 60. Booth-like enclosure 76 may in turn be assembled from individual panels or may be fabricated and sold as a unitary enclosure, either by itself for small items or equipment, or for attachment to a larger enclosure in the manner illustrated.

Figure 6A:
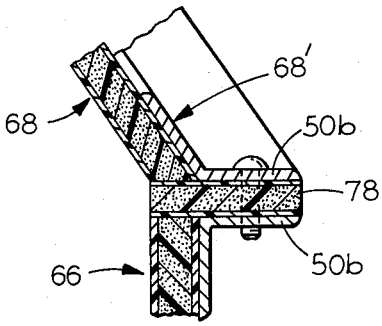
FIG. 6A is a cross-sectional view taken along the line 6*a*—6*a* of FIG. 6 and is greatly enlarged in scale relative to FIG. 6.

FIG. 6A shows in cross section the attachment between panels 66 and 68. It will be noted that the angle iron of frame member 68' of the structural framework of panel 68 has flanges which are not at right angles to each other but at an obtuse angle relative to each other. This accommodates the angle at which panels 66 and 68 are disposed to each other as viewed in FIG. 6A. In order to provide the acoustical seal between panels 66 and 68, a strip of sound deadening or absorbing material is interposed between support flange **50*b* of the structural framework of panel 68 and support flange 50*b* of the structural framework of panel 66. Strip 78 may be permanently affixed to either one of panel 66 or panel 68. However, to provide flexibility and standardization of panels, strip 78 may be provided loose to be employed in effect as a gasket for sound deadening material between panels. Sound deadening material 78**, particularly the vinyl plastic, polyurethane foam composition illustrated, may be provided cut to convenient lengths or strips, or may be readily cut from sheets of material as required by the user.

Figure 7:
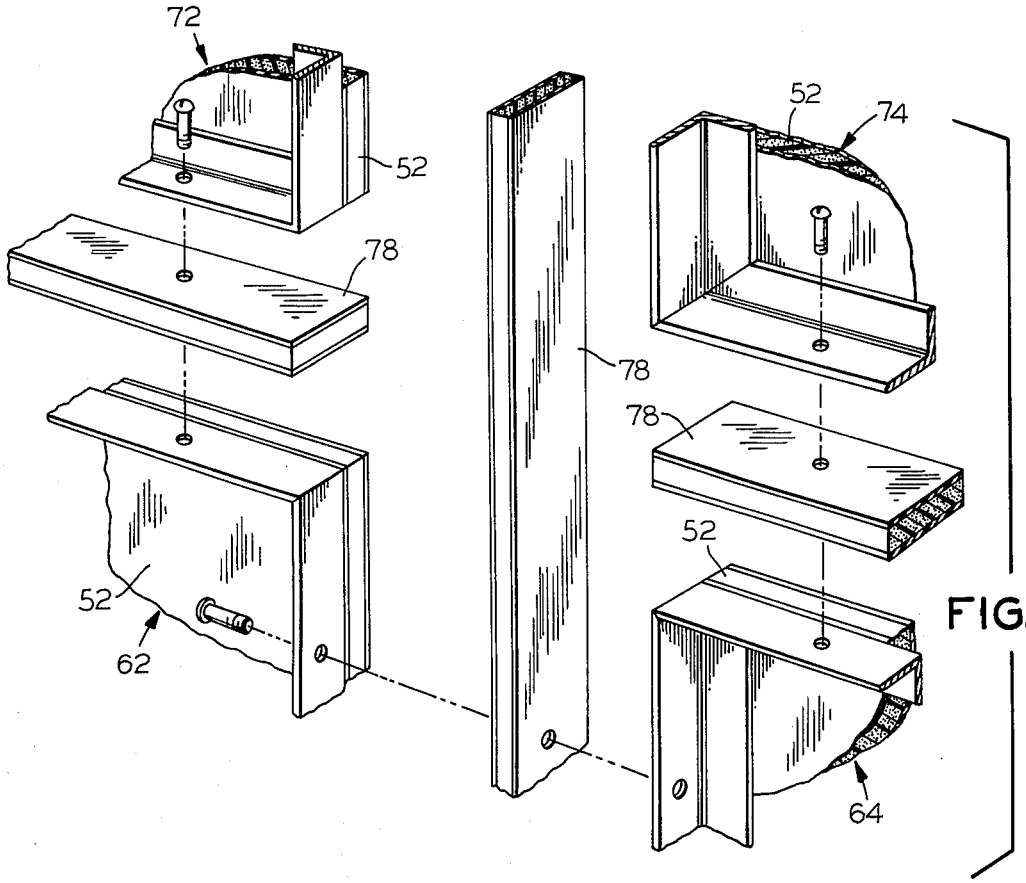
FIG. 7 is a partial exploded view of the side panels of the structure of FIG. 6 adjacent their point of juncture and is on a scale greately enlarged with respect to FIG. 6.

FIG. 7 shows an enlarged partial view, the juncture of panels 62, 64, 74, and 72. Each of panels 62, 64, 74, and 72 has its sound deadening sheet material 52 coextensive with the respective structural framework. As shown in the drawings, the enclosures are formed by assembling the sound deadening panels so that they are fully covered (by the sound deadening sheet material) on sides facing inwardly of the enclosure. In order to provide acoustical sealing between adjacent panels, strips 78 of preferably identical sound deadening material are interposed between abutting vertically and horizontally disposed support flanges of the adjacent panels. As is the case with strip 78 illustrated in FIG. 6A, strips 78 shown in FIG. 7 are of a width equal to the width of the support flange and thickness of sheet 52.

As will be apparent, an acousticl seal is provided between adjacent abutting panels by using a layer of sound deadening material to seal the space between frame members and abutting support flanges which are connected thereto. Preferably, the fastening means removably connecting one panel to another are adjusted to place the layer of sound deadening material into compression to insure a highly effective acoustical seal. This seal is not adversely affected by being broken by disassembly and then reconstituted since it is not necessary to break permanent or adhesive seals or to otherwise impair the structural integrity of a part.

Figure 2A:
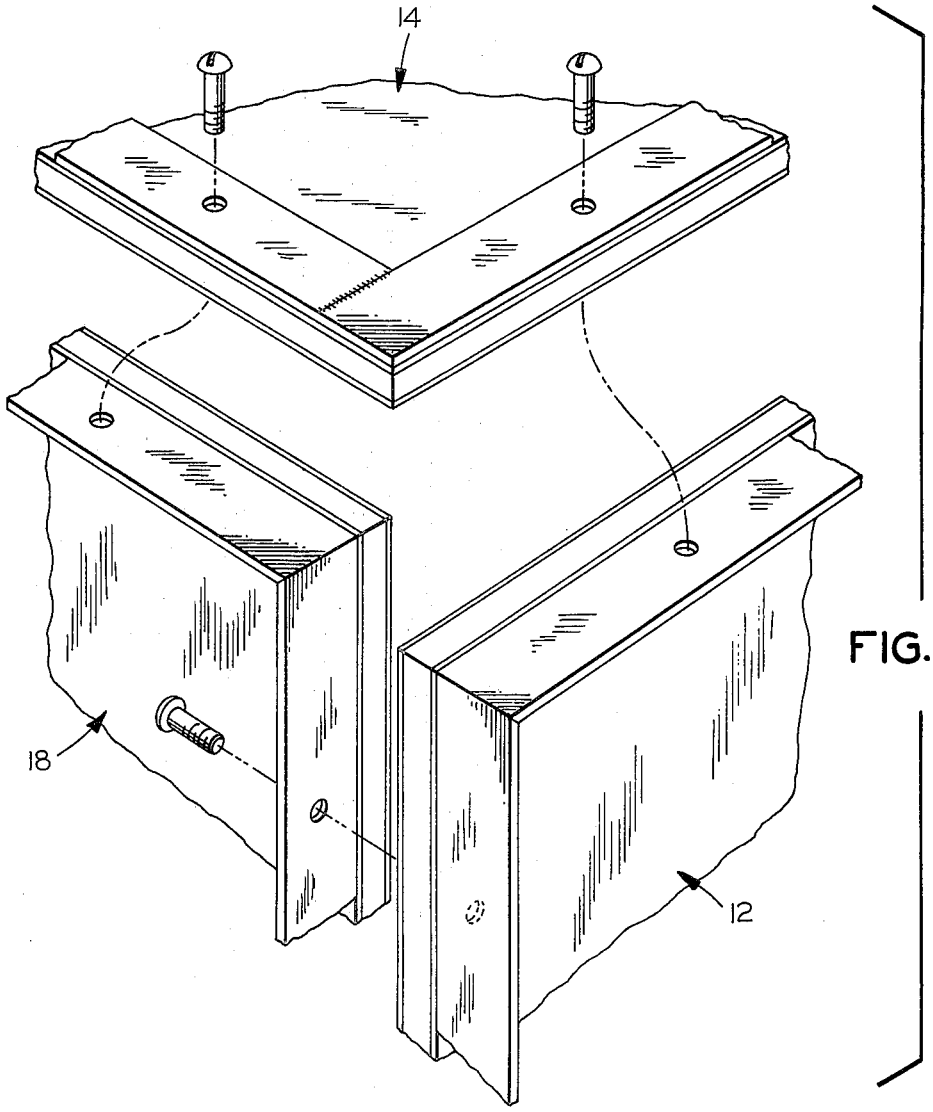
FIG. 2A is a view corresponding to that of FIG. 2, showing another embodiment of the horizontally positioned panel.

As illustrated in FIG. 2A, not every frame member requires a support flange. Thus, a panel such as a top panel 14 may be provided essentially with just a mounting flange **50*a*** as shown. However, the provision of a support flange or its equivalent may be useful to provide added structural rigidity to the structural framework of the top panel even though, as illustrated in FIG. 3, the support flange of the top panel may not be required for connection to another member. Further, by utilizing support flanged top panels, a standard sound deadening panel construction may be employed for use either as a side panel or a top panel.

Usually, enclosures such as enclosures 10 and 60 illustrated will be erected around machinery and therefore a floor of the enclosure is not required. Obviously, a floor may be included if desirable or necessary. It will be apparent from the foregoing, that the invention provides sound deadening panels which may be prefabricated in a series of standard sizes and shapes and the standard panels assembled quite simply into any required shape and size of enclosure. The compression sealing of sound deadening material between adjacent panels provides highly efficient acoustical sealing and the capability of disassembling and reassembling the enclosure without adversely effecting the seals. Further, it will be noted that the enclosure is arranged so that the structural framework is entirely shielded from the noise source enclosed by the enclosure by the sound deadening material. Thus, noise transmission through the exterior structural framework is minimized.

What is claimed is:

1. A sound deadening enclosure comprising:

(a) a plurality of sound deadening panels disengageably assembled to each other to form said enclosure, said panels each having:

(1) a structural frame extending about the periphery thereof and comprised of oppositely disposed frame members secured to each other to provide said frame and an opening therein;

(2) each of said frame members of a panel having a mounting surface extending inwardly of the periphery of said frame;

(3) a sheet of sound deadening material extending across and closing said opening and overlying said mounting surfaces of said frame members of each structural frame;

(4) means securing the overlying portions of each of said sheets to the mounting surfaces it overlies, each of said sheets of sound deadening material being disposed so as to cover its associated structural frame whereby said structural frame is completely shielded by said sound deadening material from the interior of said enclosure; and (b) fastening means disengageably connecting abutting frame members of adjacent panels to each other with a portion of said sound deadening sheet of said panels interposed between at least some abutting frame members to provide an acoustical seal therebetween.

2. The sound deadening enclosure of claim 1 further including at least one strip of sound deadening material interposed between those of said abutting frame members which do not have said portion of said sound deadening sheet of said panels interposed therebetween, said strip providing an acoustical seal between the abutting frame members between which it is interposed.

3. The sound deadening enclosure of claim 1 wherein at least some of said frame members are angle irons having at least two flanges, one flange of each of said angle irons providing said mounting surfaces in the form of mounting flanges, and another flange of each of said angle irons providing support flanges.

4. The sound deadening enclosure of claim 3 wherein at least some of said abutting frame members are disengageably connected by their support flanges.

5. The sound deadening enclosure of claim 1 wherein peripheral edge portions of said sheets of sound deadening material are compressed between said abutting frame members.

6. The sound deadening enclosure of claim 5 wherein said sheets of sound deadening material respectively comprise a core of foamed plastic material sandwiched between opposed layers of plastic material which is of higher density than said foamed plastic material.

7. The sound deadening enclosure of claim 6 wherein said foamed plastic material is a polyurethane foamed material and said layers of plastic material are vinyl materials.

8. The sound deadening enclosure of claim 1 wherein said sound deadening material sheet is a resilient, compressible material.

9. The sound deadening enclosure of claim 3 wherein said fastening means disengageably connect mounting flanges of frame members of selected panels to support flanges of abutting frame members of adjacent panels with which said selected panels are assembled in non-coplanar relationship.

10. The sound deadening enclosure of claim 3 wherein said fastening means disengageably connect support flanges of frame members of selected panels to support flanges of abutting frame members of adjacent panels with which said selected panels are assembled in co-planar relationship.

11. The sound deadening enclosure of claim 10 further including a strip of sound deadening material interposed between adjacent panels assembled in coplanar relationship, said strip of material providing an acoustical seal between said adjacent panels.

12. The sound deadening enclosure of claim 10 further including strips of sound deadening material interposed between at least selected adjacent ones of said panels in acoustical sealing relationship therebetween.

13. The sound deadening enclosure of claim 1 further including a hinged door access panel inset within surrounding panels.

14. The sound deadening enclosure of claim 13 wherein said surrounding panels have mounting flanges and support flanges and said support flanges of said surrounding panels are set back from the periphery of said surrounding panels adjacent said door panel to provide clearance for peripheral edge portions of said door panel to seat against said mounting flanges of said surrounding panels.

15. A sound deadening panel adapted to be disengageably assembled with other like panels to form a sound deadening enclosure comprises:

(a) a structural frame extending about the periphery of said panel, said frame being formed of oppositely disposed frame members secured to each other to provide said frame and an opening therein;

(b) each of said frame members having one surface extending inwardly of the periphery of said frame to provide a mounting surface and another surface extending divergingly from the mounting surface to provide a support surface extending from said mounting surface towards the side of said frame opposite said mounting surface;

(c) a sheet of sound deadening material extending across and closing said opening to define one side of said panel and having peripheral edge portions which overlie said mounting surface, said sheet of sound deadening material being disposed so as to cover said structural frame whereby said structural frame is completely shielded by said sound deadening material on said one side of said panel;

(d) means securing said peripheral edge portions of said sheet to said mounting surface; and (e) means in said support surface to permit disengageable connection of said panel to said other like panels.

16. The panel of claim 15 wherein said sound deadening material is a composite sheet having a foamed plastic material core sandwiched between opposed layers of a plastic material whose density is greater than that of the foamed plastic material, which composite sheet is resiliently compressible.

17. The sound deadening panel of claim 16 wherein said foamed plastic material is a polyurethane foam and said opposite layers of plastic material are made of a vinyl material.

18. The sound deadening panel of claim 15 wherein said frame members are angle iron members having two flanges, one flange thereof providing said mounting surface in the form of a mounting flange and the other flange thereof providing said support surface in the form of a support flange.

19. The sound deadening panel of claim 18 wherein said angle iron members are formed of right-angle angle iron with one flange thereof disposed at a right angle to the other flange thereof.

* * * * *